US006113463A

United States Patent [19]

Hasegawa et al.

[11] Patent Number: 6,113,463

[45] Date of Patent: Sep. 5, 2000

[54] METHOD OF AND APPARATUS FOR MIRROR-LIKE POLISHING WAFER CHAMFER WITH ORIENTATION FLAT

[75] Inventors: Fumihiko Hasegawa; Yasuyoshi Kuroka; Toshihiro Tsuchiya, all of Fukushima; Koichiro Ichikawa; Yasuo Inada, both of Nagano, all of Japan

[73] Assignees: Shin-Etsu Handotai Co., Ltd., Tokyo; Fujikoshi Machinery Corp., Nagano, both of Japan

[21] Appl. No.: 08/623,771

[22] Filed: Mar. 29, 1996

[30] Foreign Application Priority Data

Mar. 31, 1995 [JP] Japan ..... 7-100070

[51] Int. Cl.[7] ..... B34B 49/00; B34B 9/02

[52] U.S. Cl. ..... 451/6; 451/44

[58] Field of Search ..... 451/44, 6, 43, 451/251, 254, 258

[56] References Cited

U.S. PATENT DOCUMENTS

| | | | |
|---|---|---|---|
| 4,197,679 | 4/1980 | Yamada et al. | 451/251 |
| 5,074,079 | 12/1991 | Park | 451/43 |
| 5,097,630 | 3/1992 | Maeda et al. | 451/254 |
| 5,216,844 | 6/1993 | Tamburini et al. | 451/6 |
| 5,317,836 | 6/1994 | Hasegawa et al. | 451/44 |
| 5,538,463 | 7/1996 | Hasegawa et al. | 451/6 |

FOREIGN PATENT DOCUMENTS

| | | | |
|---|---|---|---|
| 3016959 | 1/1988 | Japan | 451/190 |

*Primary Examiner*—Robert A. Rose

*Attorney, Agent, or Firm*—Evenson, McKeown, Edwards & Lenahan, P.L.L.C.

[57] ABSTRACT

A method for chamfer mirror-like polishing a wafer having an orientation flat by rotating the wafer in a state of being pressed by a rotating buffering wheel with a predetermined pressure, is disclosed. Mirror-surface polishing a stable wafer chamfer can be obtained with a relatively simple control system. The invention is predicated in the fact that the wafer rotation speed $N_s$ has low inertial mass and low rotation speed so that the wafer rotation speed control can be obtained with high response property and high accuracy compared to pressing pressure control and buffering wheel control, and it features detecting intrinsic peripheral part, corners and orientation flat part of wafer according to a detection signal of detection means for detecting the wafer mirror-like polishing position and controlling the wafer rotation speed $N_s$ according to the detected wafer mirror-like polishing position.

4 Claims, 4 Drawing Sheets

METHOD OF AND APPARATUS FOR MIRROR-LIKE POLISHING WAFER CHAMFER WITH ORIENTATION FLAT

BACKGROUND OF THE INVENTION

1. Field of the Invention

This invention relates to a method of and an apparatus for mirror-like polishing a chamfer of a semiconductor single crystal wafer (hereinafter referred to as wafer having an orientation flat).

2. Description of the Prior Art

Wafer chamfer mirror-like polishing of a wafer comprising a semiconductor single crystal, is made for such purposes as preventing dust generation and coping with liquid pool when washing the wafer.

Such wafer, as shown in FIG. 5, has its periphery formed with an orientation flat part $W_2$. At corners $W_3$ between the intrinsic peripheral part $W_1$ and orientation flat part $W_2$, the curvature radius $r_3$ is very small, and in this locality the relative curvature radius with respect to the buffing wheel for mirror-like polishing the wafer 1 is extremely small compared to the other localities. Therefore, with a constant pressing pressure the contact pressure p is very high at the corners $W_3$. In the meantime, when the wafer is rotating at a constant rotation number, the speed of movement of the point of contact between the wafer chamfer and the buffing wheel is greatly reduced at the corners, thus extending the process time at this locality. For the above reasons, the mirror-like polishing of the corners $W_3$ that is done under the same mirror-like polishing conditions (i.e., wafer rotation speed, pressing pressure between the buffing wheel and wafer, rotation speed of the buffing wheel, etc.) as for the intrinsic peripheral part $W_1$ and orientation flat part $W_2$, results in excessive wear or wedging of the buffing wheel at the corners.

The capacity C of wafer chamfer mirror-like polishing is obtained from the following general approximation equation $$C=a_1pV_bT$$

where $a_1$ is a constant ($a_2, \ldots, a_n$ appearing in the following being the same), p is the contact pressure, $V_b$ is the relative speed $N_b$ ($N_b$ being the rotation speed of the buffing wheel), T is the contact time $1/N_S$ ($N_S$ being the rotation speed of the wafer). Hence, $$N_S=a_2pN_b/C$$

As for p (approximated by two-circle contact between wafer circle and buffing wheel circle)

$$p=a_3\{F(1/R1+1/R2)\}^{1/2} \text{ (F being the pressing pressure).}$$

Hence, $$N_S=a_4N_b\{F(1/R_1+1/R_2)\}^{1/2}/C$$

Assuming that $a_4$, $N_b$, C and F are constant, we have $$N_S=a_5\{(1/R_1+1/R_2)\}^{1/2}$$

where $R_1$ (diameter of the buffing wheel) is constant. Taking $R_2$ (diameter of the wafer) as a variable, relation as shown in Table 1 below is obtained in connection with the showing in FIG. 5.

TABLE 1

| Wafer peripheral position | $W_2$ | $W_1$ | $W_3$ |
|---|---|---|---|
| $R_2$ | Large (∞) | Medium ($r_1$) | Small ($r_3$) |
| $N_S$ | Small | Medium | Large |

When the pressing pressure F (Kgf) of the buffing wheel is constant, the area of contact between the wafer and the buffing wheel is small with a small relative curvature radius of the wafer and large with a large relative curvature radius.

It is thus possible to control the wafer chamfer mirror-like polishing capacity C through control of p, $N_S$ and $N_b$ noted above.

A technique of controlling the excessive wear of the corners of wafer through control of the contact pressure p between the wafer and buffing wheel while controlling the wafer chamfer mirror-like polishing capacity C, is shown by the applicant in Japanese Laid-Open Patent Publication No. 6-155263.

In this technique, when mirror-like polishing the wafer chamfer, the mirror-like polishing capacity C is made uniform for the orientation flat part, intrinsic peripheral part and corners by varying the pressing pressure between the wafer and buffing wheel according to a wafer position detection signal from wafer position detecting means, which makes a determination as to whether the wafer mirror-like polishing position corresponds to the orientation flat part, intrinsic peripheral part or corner.

The curvature radius of the corner is about 2 mm, and with an 8" wafer (with a radius of about 100 mm) which has the orientation flat part $W_2$ as noted above, the processing time of the corner $W_3$ is usually reduced to a couple of seconds by setting the wafer rotation speed to about one minute per one round.

However, when the wafer mirror-like polishing position goes from intrinsic peripheral part $W_1$ to corner $W_3$ and from corner $W_3$ to orientation flat part $W_2$, the mirror-like polishing capacity C is varied in these localities as shown by the solid plot in FIG. 4(B) unless the pressing pressure is quickly raised and lowered. In the above technique of controlling the pressing pressure between the wafer and buffing wheel, the pressing pressure generating means employs an air cylinder which is inferior in the response property. Therefore, a response delay is generated as shown by the dashed plot in FIG. 4(B). This frequently results in the occurrence of excessive mirror-like polishing or wedging into the buffing wheel particularly at the corner $W_3$.

The follow-up property can be improved by using an oil hydraulic cylinder. In wafer mirror-like polishing, however, oil is undesired because it causes impurity introduction.

It is possible to control the rotation speed Nb of the buffing wheel for the control of the mirror-like polishing capacity C. However, the buffing wheel is rotated at a high rotation number and has a high moment of inertia. The high momentum thus generated deteriorates the response property, so that it is difficult to obtain fine and accurate control.

SUMMARY OF THE INVENTION

An object of the invention is to provide a method of and an apparatus for wafer chamfer mirror-like polishing, which permits satisfactory and accurate response in the chamfer mirror-like polishing control particular at the corners, can realize stable chamfer mirror-like polishing control with a relatively simple control system and can realize uniform chamfer mirror-like polishing for the corners, orientation flat part and intrinsic peripheral part.

The invention is predicated in the facts that the contact (or mirror-like polishing) time T corresponds to the wafer rotation speed $N_S$ and that the wafer rotation control provides for high response and high accuracy compared to the pressing pressure control or buffing wheel rotation speed control because the wafer rotation speed $N_S$ is low speed and has low mass of inertia.

The invention features a method of mirror-like polishing chamfer of a wafer having an orientation flat with a rotating buffing wheel pressed against the wafer chamfer with a predetermined pressure while rotating the wafer, wherein:

the wafer rotation speed $N_S$ is changed in correspondence to wafer mirror-like polishing positions of intrinsic peripheral part, corners and orientation flat part of the wafer according to detection signal from detecting means for detecting the wafer mirror-like polishing positions.

As a structure suitable for carrying out such a method, the invention features an apparatus for mirror-like polishing chamfer of a wafer having an orientation flat comprising a wafer rotating mechanism for rotating the wafer mounted thereon, a buffing wheel rotating mechanism for rotating a buffing wheel for mirror-like polishing the wafer, and a pressing mechanism for pressing the wafer and buffing wheel with a predetermined pressure, the rotating buffing wheel being pressed against the wafer chamber with a predetermined pressure while the wafer is rotated by the wafer rotating mechanism, the apparatus further comprising:

a wafer mirror-like polishing position detector for detecting wafer mirror-like polishing positions; and wafer rotation speed control means for controlling the wafer rotation speed $N_S$ according to a detection signal from the wafer mirror-like polishing position detector;

the wafer rotation speed $N_S$ is changed in correspondence to wafer mirror-like polishing positions of intrinsic peripheral part, corners and orientation flat part of the wafer according to detection signal from the wafer mirror-like polishing position detector.

The wafer rotating mechanism may be a stepping motor. The wafer mirror-like polishing position detector may be a photo-sensor or the like, which is disposed at a position deviated from the mirror-like polishing position by a predetermined angle in the circumferential direction of the wafer to detect the intrinsic peripheral part, corners and orientation flat part of the wafer. This is by no means limitative, however; for instance, it is possible to use an angle detector, which detects the wafer rotation angle from a pulse output of a stepping motor.

According to the invention having the above constitution, the wafer rotation speed $N_S$ is about one minute per one round, which is very low compared to the buffing wheel rotation speed $N_b$. This means that it is possible to obtain accurate wafer rotation control without response delay by using a stepping motor or a pulse motor. Thus the wafer rotation speed $N_b$ can be quickly and accurately increased and reduced when the wafer mirror-like polishing position goes from intrinsic peripheral part $W_1$ to corner $W_3$ and from corner $W_3$ to orientation flat part $W_2$, and stable mirror-like polishing capacity C can be maintained over the entire wafer circumstance as shown in FIG. 4(A).

According to the invention, a mirror-like polishing system thus can be provided, which is adapted to control the rotation of wafer with less inertial momentum and lower rotation speed, thus permitting wafer chamfer mirror-like polishing with superior response property and with a comparatively simple control system.

In addition, according to the invention, in addition to the above effect, the wafer rotation speed $N_S$ is controlled by detecting the mirror-like polishing position of the wafer and providing correction according to the detected position. It is thus possible to obtain uniform speed chamfer mirror-like polishing of the intrinsic peripheral part, orientation flat part and corners of wafer. Particularly, it is possible to prevent excessive corner mirror-like polishing or buffing wheel wedging.

Figure 1:
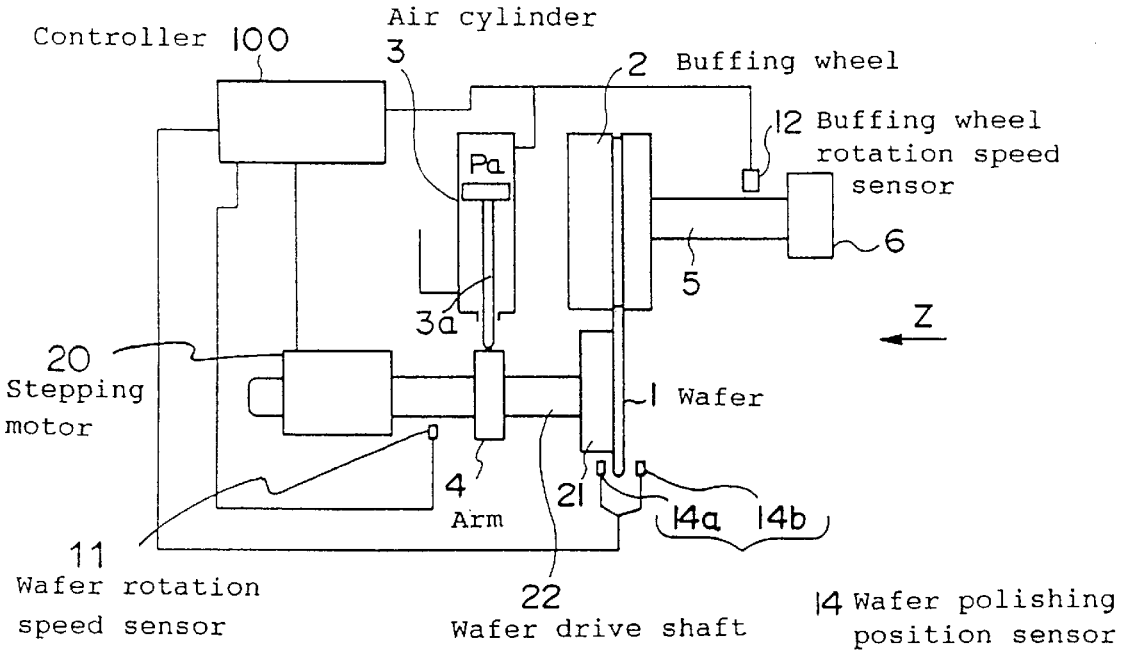
FIG. 1 is a schematic representation of a wafer chamfer mirror-like polishing apparatus according to the invention.

In the Figures, reference numeral 1 designates a wafer, 2 a buffing wheel, 3 an air cylinder, 11 a wafer rotation speed sensor, 12 a buffing wheel rotation speed sensor, 13 a pressing pressure sensor, 14 a wafer mirror-like polishing position sensor, 20 a stepping motor, 100 a controller, 121 a wafer rotation speed setter, 122 a wafer rotation speed comparator, and 123 a wafer rotation speed calculator.

DETAILED DESCRIPTION OF THE PREFERRED EMBODIMENT

An embodiment of the invention will now be described in detail with reference to the drawings. It is to be construed that unless particularly specified, the sizes, materials, shapes and relative dispositions of described parts of the embodiments are not limitative but mere examples.

Figure 2:
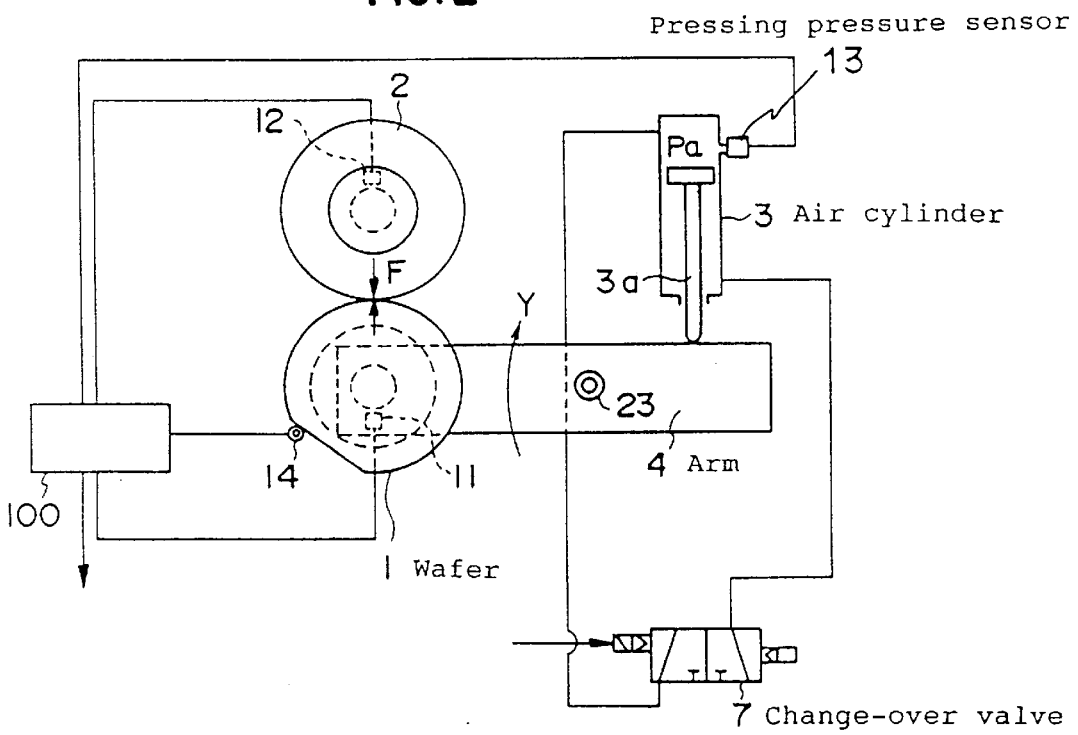
FIG. 2 is a view taken in the direction of arrow Z in FIG. 1.
Figure 3:
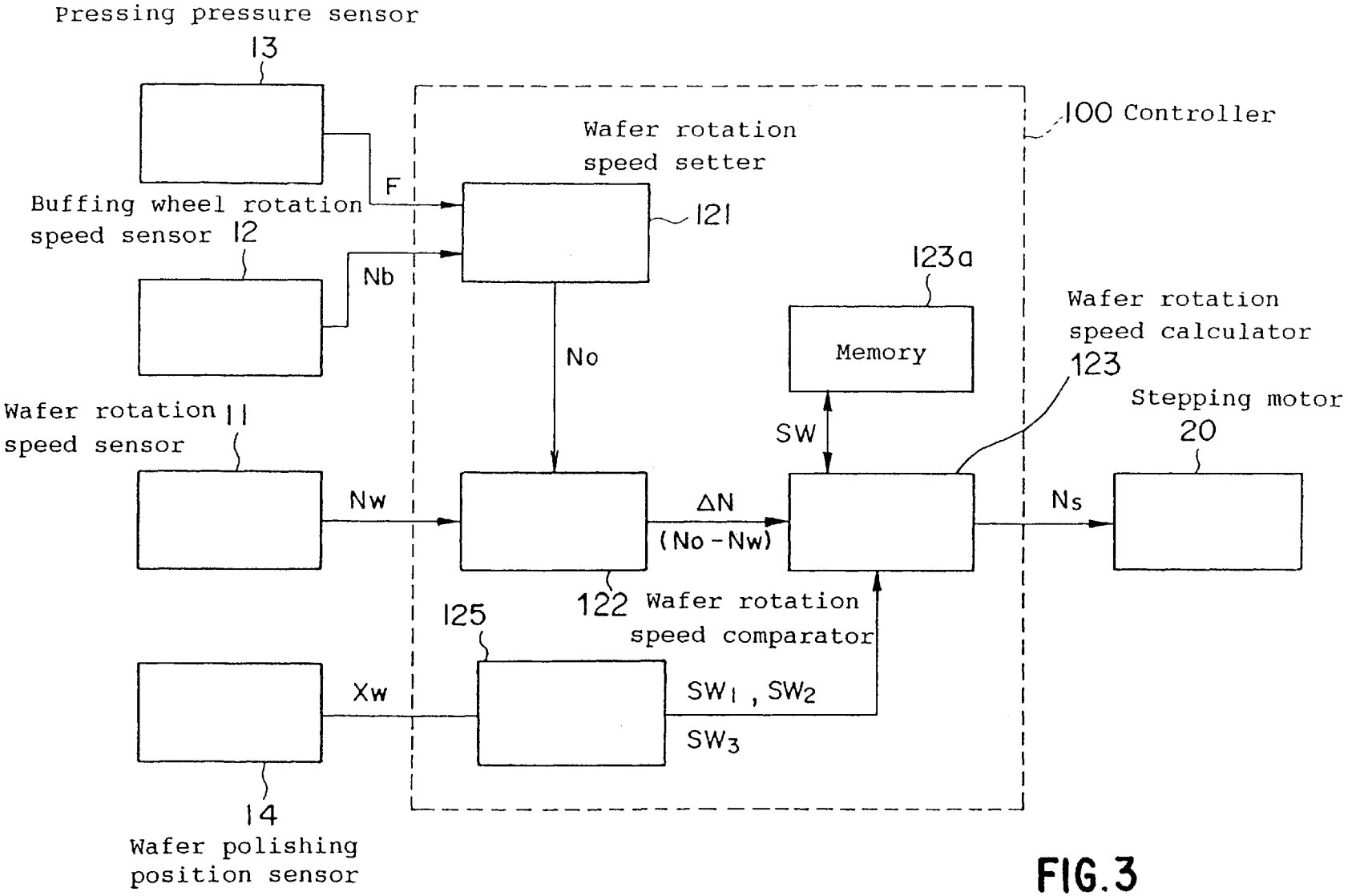
FIG. 3 is a block diagram illustrating control of a wafer drive stepping motor.
Figure 5:
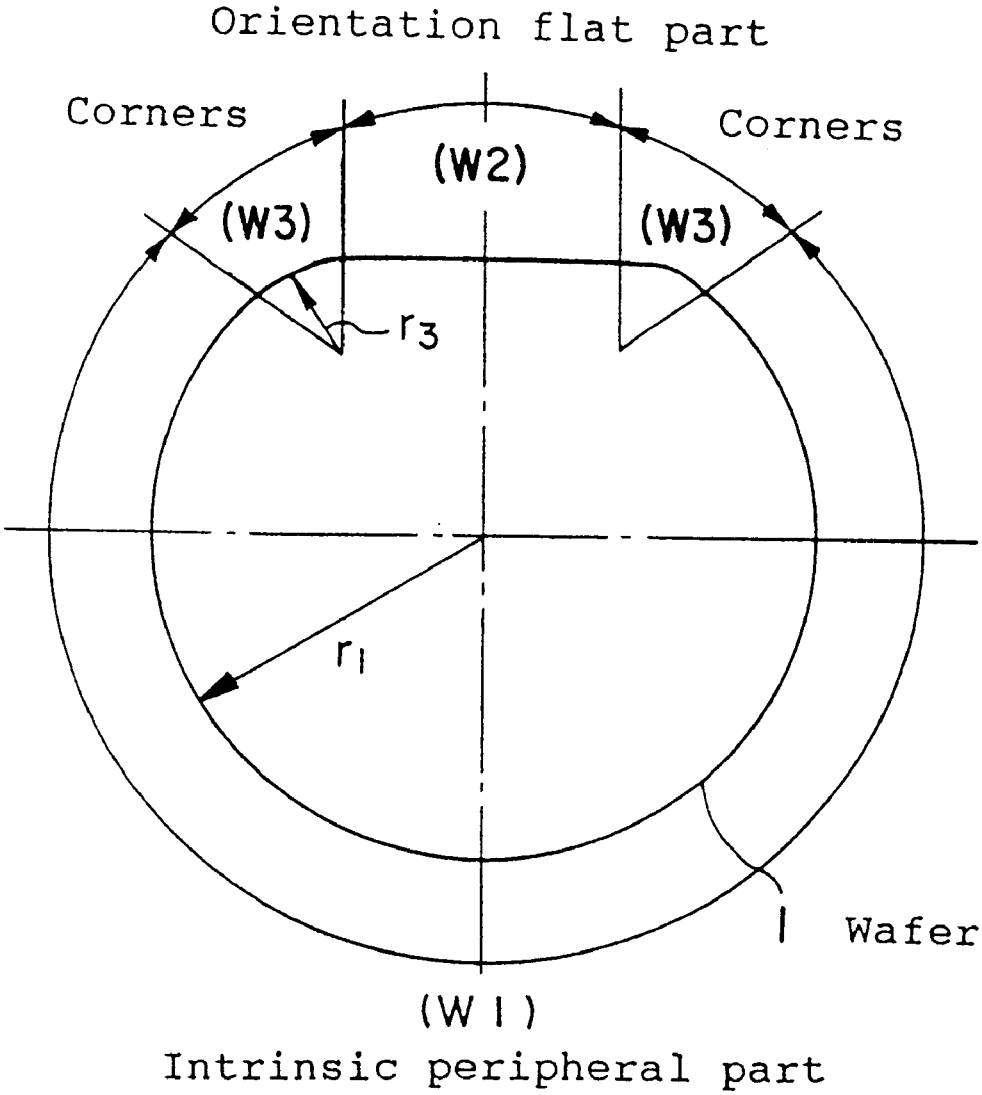
FIG. 5 is a plan view showing a wafer.

FIG. 1 shows the structure of a wafer chamfer mirror-like polishing apparatus according to the invention. FIG. 2 is a view taken in the direction of arrow Z in FIG. 1. FIG. 3 is a block diagram illustrating control of a wafer drive stepping motor. FIG. 5 is a plan view showing a wafer to be chamfer mirror-like polished according to the invention.

Referring to FIGS. 1 and 2, reference numeral 1 designates a wafer, which is set such that it is attracted to a suction board 21 secured to a wafer drive shaft 22.

Reference 20 designates a stepping motor for step-by-step driving the wafer drive shaft 22.

Reference numeral 4 is an arm, which has a central portion pivoted on a pivotal pin 23, one end fitted on the wafer drive shaft 22 and the other end capable of being contacted by a piston rod 3*a* of an air cylinder 3 to be described later.

The air cylinder 3 is operable by operating air from a change-over valve 7. Its piston rod 3*a* and one end in contact with the corresponding end face of the arm 4.

When the air cylinder 3 is operated to push the arm end with the piston rod 3*a*, the arm 4 is pivoted about the pivotal pin 23 in the direction of arrow Y in FIG. 2 to generate a pressing pressure F between a buffing wheel 2 to be described later and the wafer 1.

The buffing wheel 2 is for chamfer mirror-like polishing the wafer 1. It is driven for rotation at a rotation speed $N_b$ from a motor 6 via a shaft 5.

Reference numeral 11 is a wafer rotation speed sensor for detecting the rotation speed $N_S$ of the wafer drive shaft 22 (i.e., the rotation speed of the stepping motor 20). Reference numeral 12 designates a buffing wheel rotation speed sensor for detecting the rotation speed of the buffing wheel drive shaft 5.

The wafer 1 has a shape as shown in FIG. 5, having an intrinsic peripheral part $W_1$ with radius $r_1$, an orientation flat part $W_2$ formed as a flat notch, and corners $W_3$ with radius $r_3$ between the intrinsic peripheral part and orientation flat part.

Reference numeral 14 designates a photo-sensor serving as a wafer mirror-like polishing position sensor, which detects the mirror-like polishing position of the wafer having the shape as described above and provides a detection signal as its input to a controller 100 to be described later. The photo-sensor 14 is disposed at a position deviated from the mirror-like polishing position by a predetermined angle in the circumferential direction of the wafer. It can detect the intrinsic peripheral part, corners and orientation flat part of wafer.

Reference numeral 13 is a pressing pressure sensor for detecting the operating air pressure in the air cylinder 3, i.e., pressing pressure between the buffing wheel 2 and the wafer 1.

The controller 100 receives data of the operating air pressure in the air cylinder 3, i.e., the pressing pressure F between the wafer 1 and buffing wheel 2, from the pressing pressure sensor 13, data of the buffing wheel rotation speed $N_b$ from the buffing wheel rotation speed sensor 12, data of the rotation speed of the stepping motor 20, i.e., the wafer rotation speed $N_S$, from the wafer rotation speed sensor 11, and data of the mirror-like polishing position of the wafer from the wafer mirror-like polishing position sensor 14, and it calculates the rotation speed of the stepping motor 20 by a method to be described later, the calculated data being outputted to the stepping motor 20.

Wafer rotation speed control means according to the invention will now be described.

The controller 100, as shown in the block diagram of FIG. 3, includes a mirror-like polishing position judging unit 125, a wafer rotation speed setter 121, a wafer rotation speed comparator 122 and a wafer rotation speed calculator 123.

The wafer rotation speed setter 121 sets a reference wafer rotation speed $N_O$ (i.e., a rotation speed of the wafer periphery) from the pressing pressure F between the wafer 1 and buffing wheel 2 as detected by the pressing Pressure sensor 13 and the buffing wheel rotation speed $N_b$ as detected by the buffing wheel rotation speed sensor 12 by a method to be described later.

The wafer rotation speed comparator 122 calculates the difference ΔN between the reference wafer rotation speed $N_O$ and the detected wafer rotation speed $N_W$ of wafer 1.

The mirror-like polishing position judging unit 125 calculates the wafer mirror-like polishing position from a detection signal $X_W$ inputted from the wafer mirror-like polishing position sensor 14 to judge that the intrinsic peripheral part $W_1$, orientation flat part $W_2$ or corner $W_3$ is at the mirror-like polishing position, and sends out a judgment signal representing the wafer mirror-like polishing position (i.e., the intrinsic peripheral part $SW_1$, orientation flat part $SW_2$ or corner $SW_3$) to the wafer rotation speed calculator 123.

The wafer rotation speed calculator 123 has a memory 123*a* , in which predetermined correction values are stored. It reads out correction value data SW from the memory according to the judgment signal noted above (representing the intrinsic peripheral part $SW_1$, orientation flat part $SW_2$ or corner $SW_3$) and calculates a corrected wafer rotation speed $N_S$ after the following formula, the calculated data being outputted to the stepping motor 20.

$$N_S=N_O(1+SW) \tag{1}$$

SW: $SW_1=0$, $SW_2=-0.3$, $SW_3=+0.7$.

The operation of the wafer chamfer mirror-like polishing apparatus having the above constitution will now be described.

The pressing pressure sensor 13 detects the operating air pressure pa in the air cylinder 3, and calculates the pressing pressure F between the wafer 1 and buffing wheel 2 from the arm ratio of the arm 4, sectional area of the air cylinder 3, etc., the calculated data being inputted to the wafer rotation speed setter 121.

The reference wafer rotation speed $N_O$ which is a basis in the above equation (1) is $$N_O=a_6N_bF^{1/2}/C \tag{2}$$

The wafer rotation speed setter 121 thus calculates the reference wafer rotation speed $N_O$ corresponding to the inputted detected pressing pressure F and detected buffing wheel rotation speed $N_b$ from F, $N_b$ and desired mirror-like polishing capacity C using equation (2), the calculated data being inputted to the rotation speed controller 122.

The rotation speed controller 122 calculates the difference ΔN, i.e., $(N_O-N_W)$, between the desired reference wafer rotation speed $N_O$ and the detected wafer rotation speed $N_W$ inputted from the wafer rotation speed sensor 11, the calculated data being inputted to the wafer rotation speed calculator 123.

The wafer mirror-like polishing position sensor 14 may, for instance, use a photo-sensor.

When the intrinsic peripheral part W1 is passing by the photo-sensor, light from a light emitter 14*a* is blocked by the part $W_1$ and does not reach a light receiver 14*b*. When the orientation flat part $W_2$ is passing by the photo-sensor, on the other hand, light from the light emitter 14*a* reaches the light receiver 14*b*. The photo-sensor as the wafer mirror-like polishing position sensor 14 thus detects the orientation flat part $W_2$ from light received by the light receiver 14*b*.

The corner $W_3$ is detected as locality corresponding to the instant of switching from the state, in which light is blocked, over to the state, in which light is received.

The wafer position detection signal $X_W$ which is obtained during the mirror-like polishing of wafer in the above way, is inputted via the wafer mirror-like polishing position judging unit 125 to the wafer rotation speed calculator 123.

The wafer rotation speed calculator 123 takes out correction value data from the memory 123*a* according to $SW_1$, $SW_2$ or $SW_3$ judgment signal, and calculates the wafer rotation speed $N_S$ according to the taken-out correction data using the equation (1)

$$N_S=N_O(1+SW).$$

When SW is, for instance, $SW_1=0$, $SW_2=-0.3$ and $SW_3=+0.7$, the wafer rotation speed $N_S$ is reduced to 0.7 $N_O$ when the wafer mirror-like polishing position detection signal represents the orientation flat part $W_2$, when the signal represents the intrinsic peripheral part $W_1$, the speed $N_S$ can be corrected to just $N_O$ and maximized to 1.7 $N_O$ for the corners $W_3$.

Figure 4:
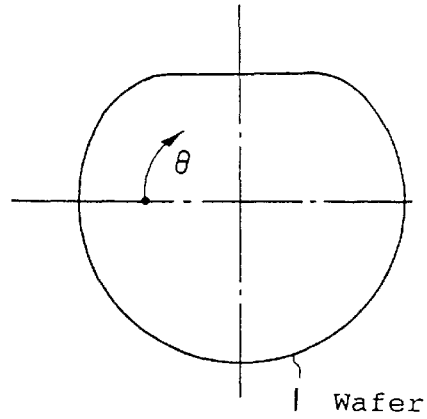
FIGS. 4, 4A and 4B show wafer mirror-like polishing state plotted against a change with the passage time.
Figure 4A:
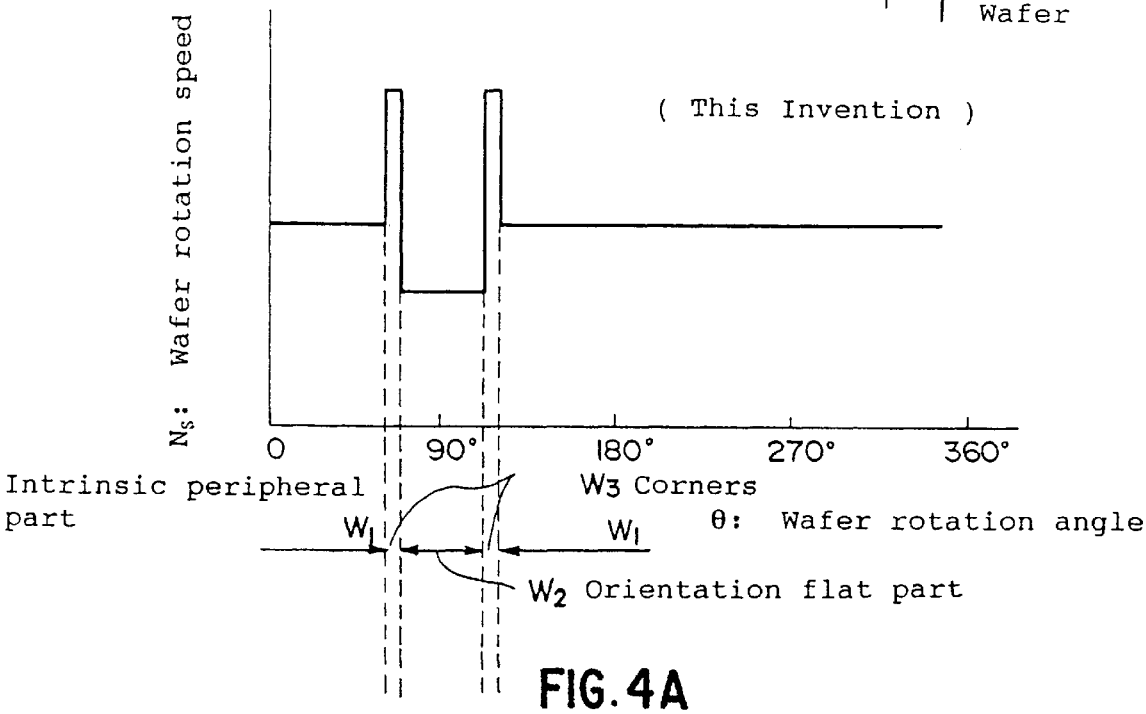

The wafer rotation speed $N_S$ which is thus corrected is as shown in FIG. 4(A). This wafer rotation speed $N_S$ is set so that the stepping motor 20 is driven at this speed.

Figure 4B:
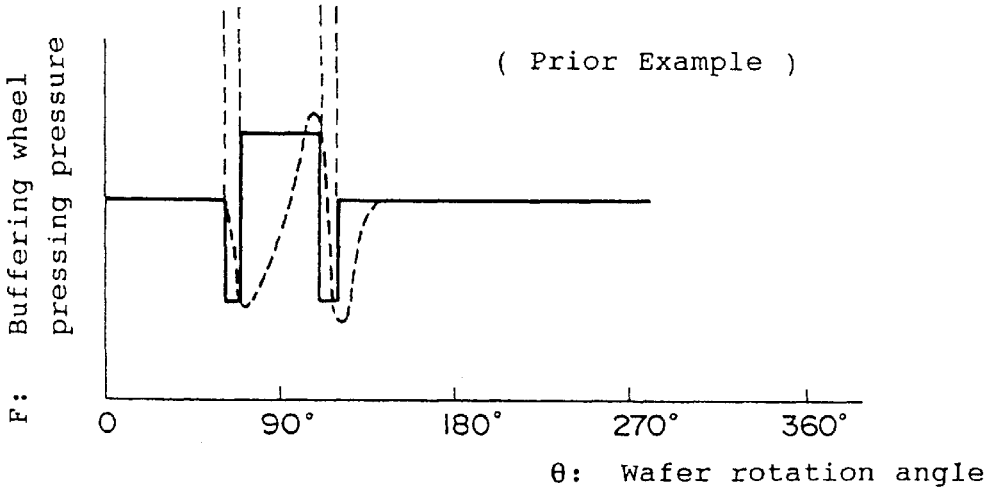

FIGS. 4(A) and 4(B) compare the response in wafer mirror-like polishing according to the invention and that in the prior art.

FIG. 4(B) shows an example of control of the pressing force between the buffing wheel and wafer in the prior art. In this case, a response delay is generated as shown by the broken plot. According to the invention, as shown in FIG. 4(A), owing to the above control of the wafer rotation speed $N_S$, the response delay is hardly generated, and high response characteristic can be ensured.

What is claimed is:

1. An apparatus for polishing a chamfer of a wafer having an orientation flat part and comprising:

a wafer rotating mechanism for rotating the wafer mounted thereon, a buffing wheel rotating mechanism for rotating a buffing wheel for polishing the wafer, a pressing mechanism for pressing the wafer and the buffing wheel with a predetermined pressure, the rotating buffing wheel being pressed against the chamfer with a predetermined pressure while the wafer is rotated by the wafer rotating mechanism, a wafer polishing position detector for detecting wafer polishing positions; and wafer rotation speed control means for controlling the wafer rotation speed according to a detection signal from the wafer polishing position detector;

the wafer rotation speed being changed in correspondence to wafer polishing positions of an intrinsic peripheral part, corners and said orientation flat part of the wafer according to said detection signal from the wafer polishing position detector so that the wafer rotation speed during polishing of the intrinsic peripheral part is less than the wafer rotation speed during polishing of the corners and greater than the wafer rotation speed during polishing of the orientation flat part.

2. The wafer chamfer polishing apparatus according to claim 1, wherein the wafer rotating mechanism is a stepping motor.

3. The wafer chamfer polishing apparatus according to claim 1, wherein the wafer polishing position detector is a photo-sensor for detecting the intrinsic peripheral part, corners and orientation flat part of the wafer.

4. The wafer chamfer polishing apparatus according to claim 1, wherein the polishing position detector is an angle sensor for detecting the rotation angle of the wafer.

* * * * *